US007438014B2

(12) United States Patent
Kim

(10) Patent No.: US 7,438,014 B2
(45) Date of Patent: Oct. 21, 2008

(54) RIGID INFLATABLE BOAT WITH EASY LIFESAVING

(75) Inventor: Han jun Kim, Gyeongsangnam-do (KR)

(73) Assignee: Woonam Marine Craft Co., Ltd., Gyeongsangnam-do (KR)

( * ) Notice: Subject to any disclaimer, the term of this patent is extended or adjusted under 35 U.S.C. 154(b) by 0 days.

(21) Appl. No.: 11/715,094

(22) Filed: Mar. 7, 2007

(65) Prior Publication Data

US 2007/0209569 A1 Sep. 13, 2007

(30) Foreign Application Priority Data

Mar. 7, 2006 (KR) ..... 10-2006-0021285
Dec. 19, 2006 (KR) ..... 10-2006-0130165

(51) Int. Cl.
*B63B 7/00* (2006.01)
*B63B 17/00* (2006.01)

(52) U.S. Cl. ..... 114/345; 114/364

(58) Field of Classification Search ..... 114/345, 114/352, 355, 362, 364; 441/39, 40, 44
See application file for complete search history.

(56) References Cited

U.S. PATENT DOCUMENTS 5,832,864 A * 11/1998 Hemphill ..... 114/345

* cited by examiner

*Primary Examiner*—Lars A Olson
*Assistant Examiner*—Daniel V Venne
(74) *Attorney, Agent, or Firm*—Jordan and Hamburg LLP

(57) ABSTRACT

A rigid inflatable boat adapted for ease of lifesaving includes an arc-shaped front tube fixedly installed at a front side of a hull and a rear tube slideably installed at a rear side of the hull. A respective sliding rail having a guiding member disposed therein extends longitudinally on an upper surface of the hull at one or both sides thereof The rear tube is slideable forward and backward along the sliding rail due to the operation of the guiding member. A first holding means for detachably supporting a rear end of the arc-shaped tube and a front end of the rear tube is installed between the rear end of the arc-shaped tube and the front end of the rear tube. An open space between a rear end of the arc-shaped front tube and a front end of the rear tube provides ease of lifesaving.

12 Claims, 9 Drawing Sheets

【Fig 1】
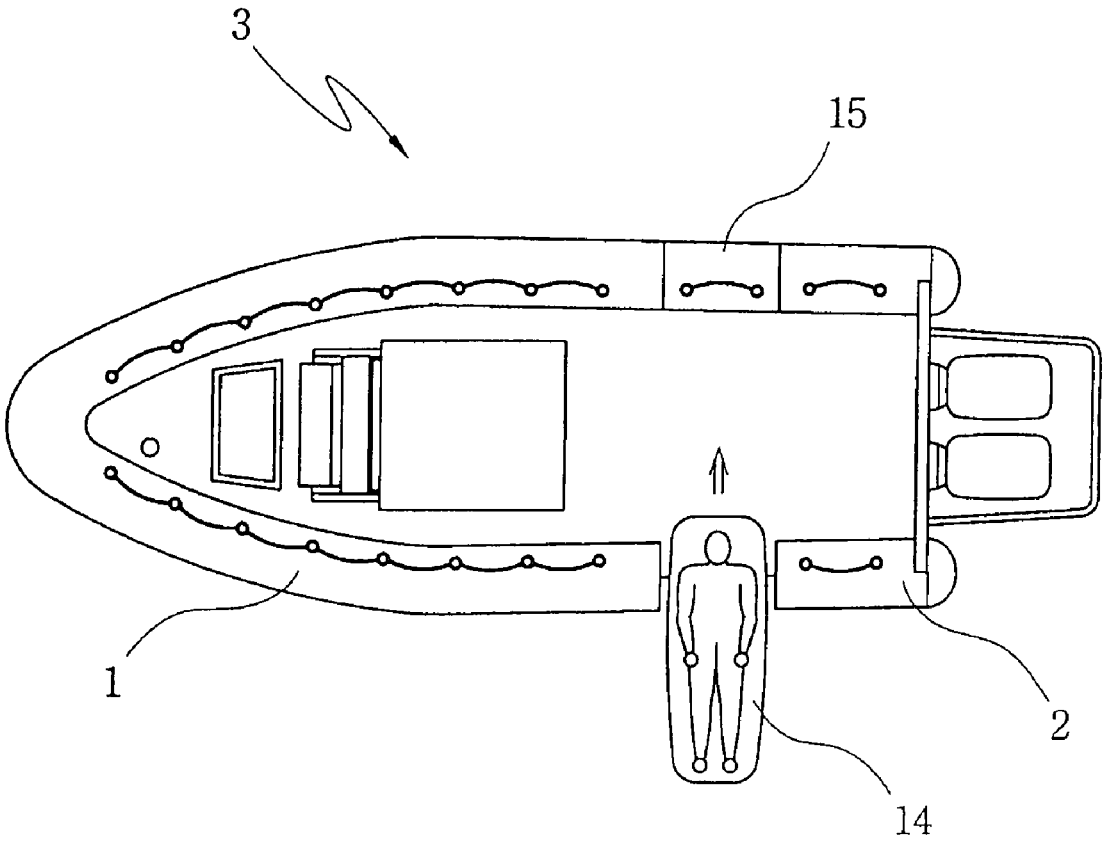
【Fig 2】
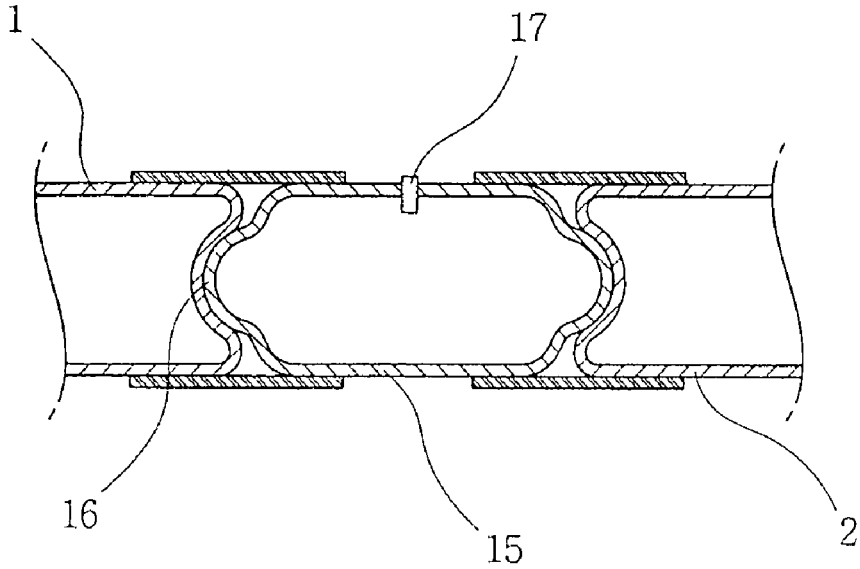

【Fig 3】
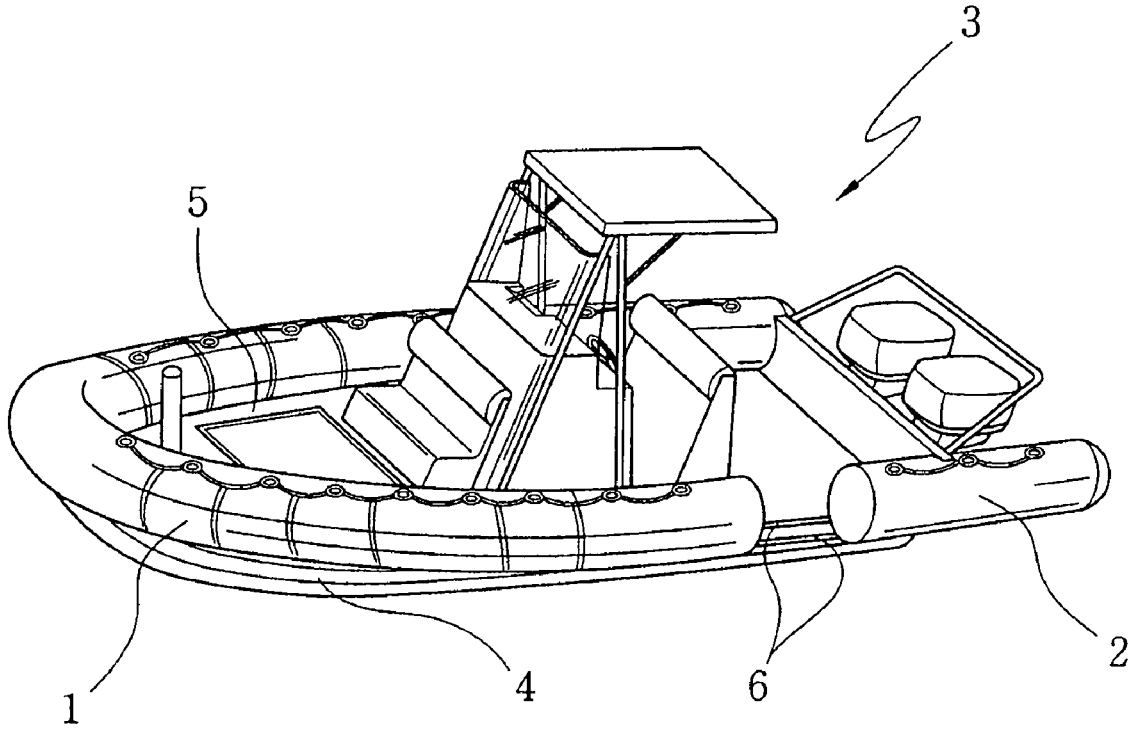
【Fig 4】
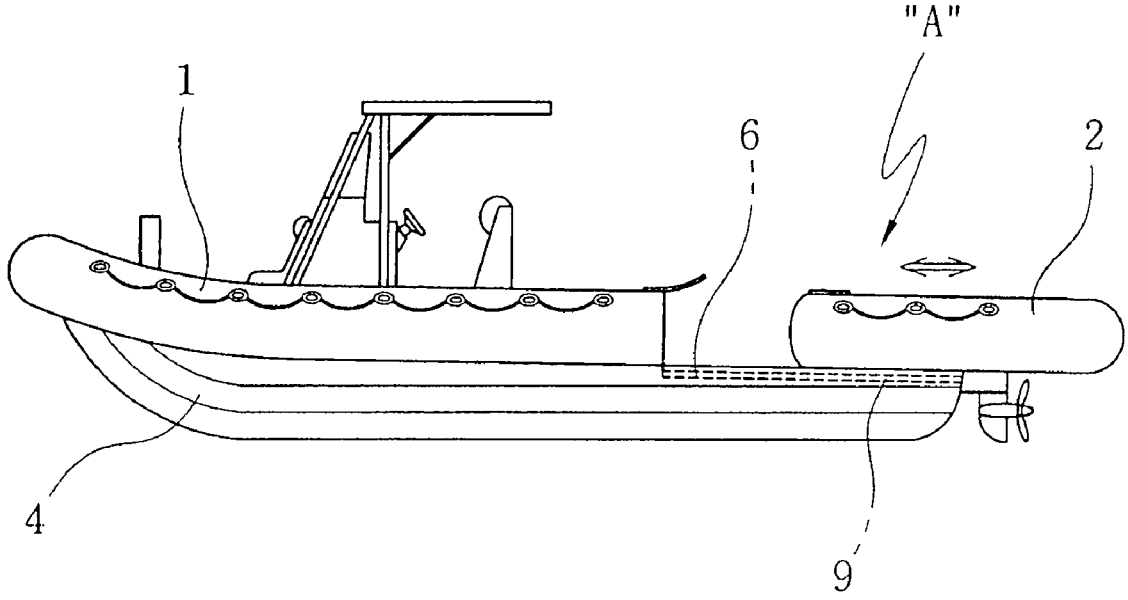

【Fig 5】
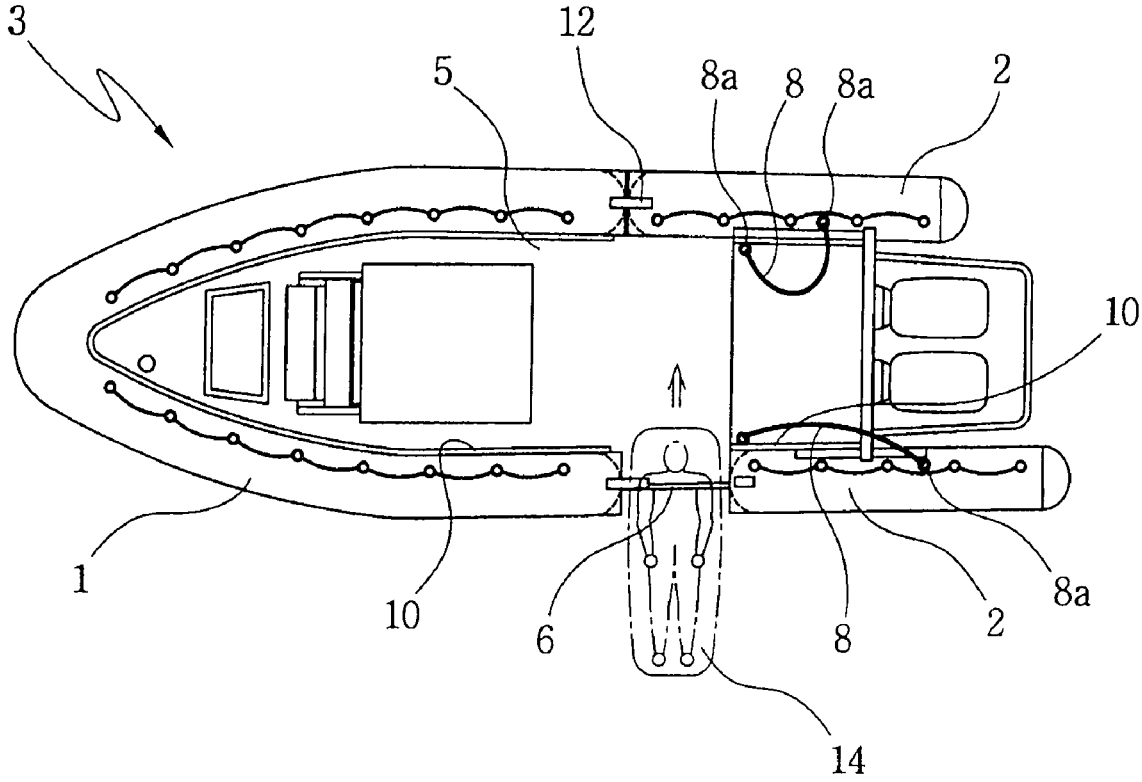
【Fig 6】
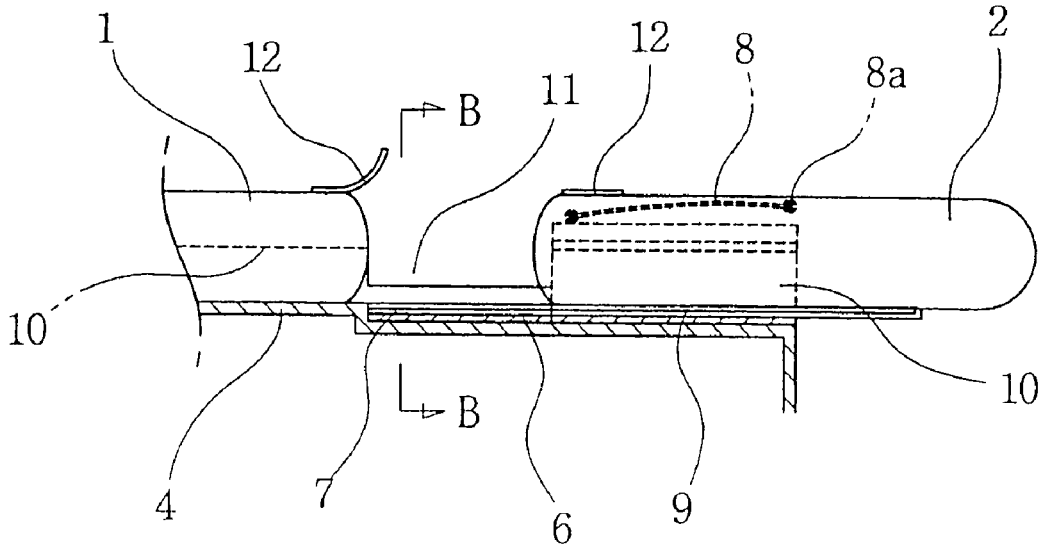

【Fig 7】
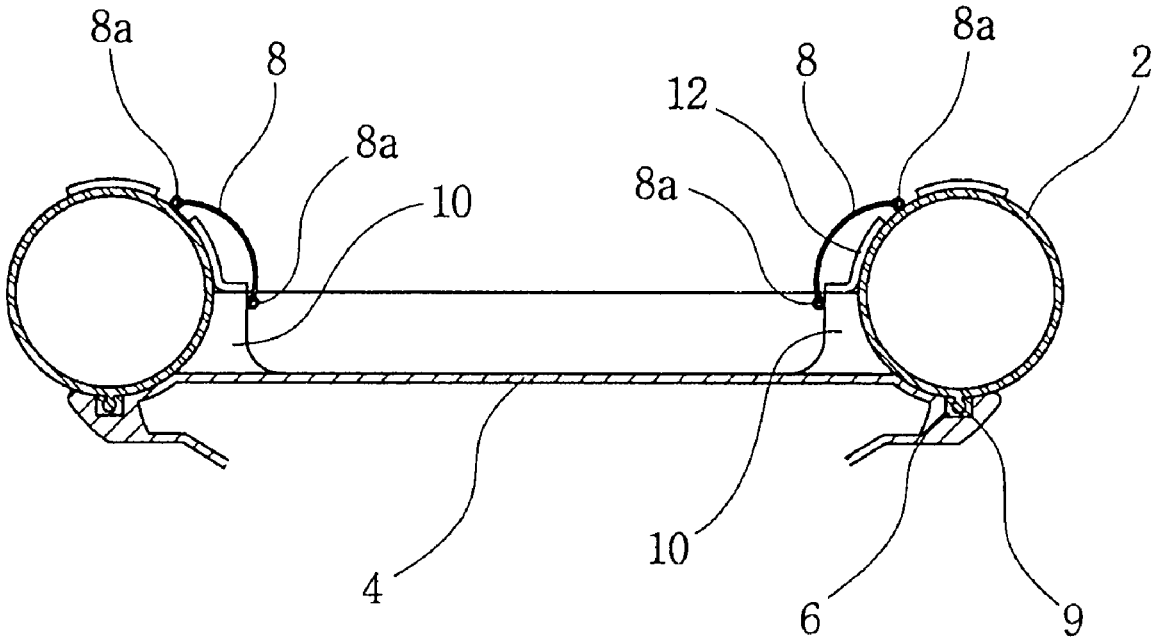
【Fig 8】
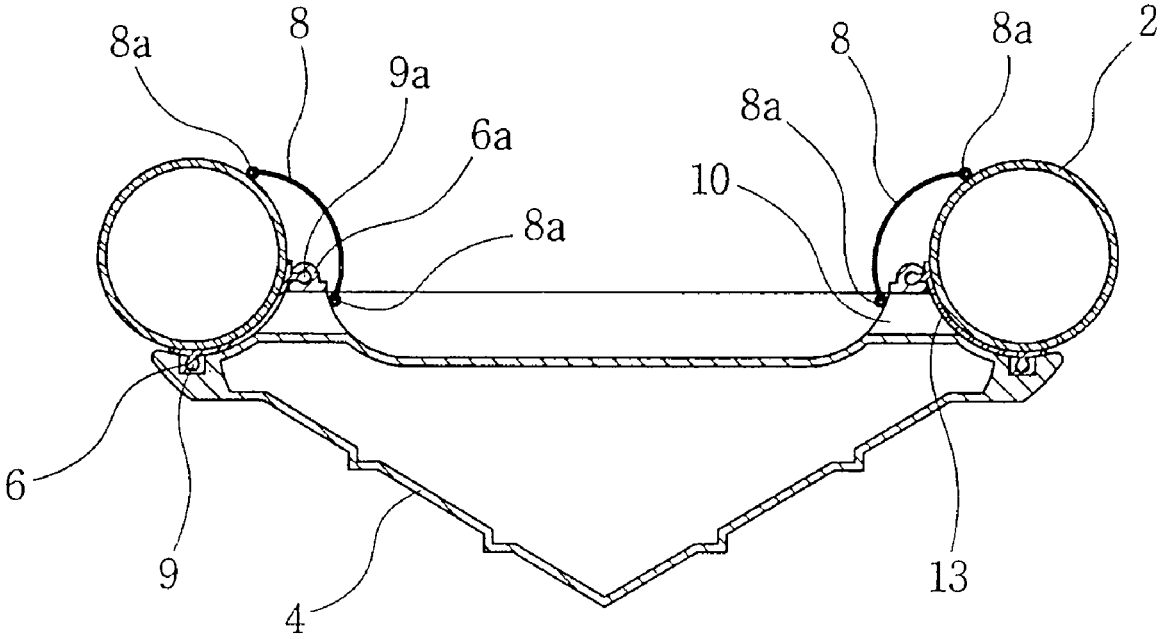

【Fig 9】
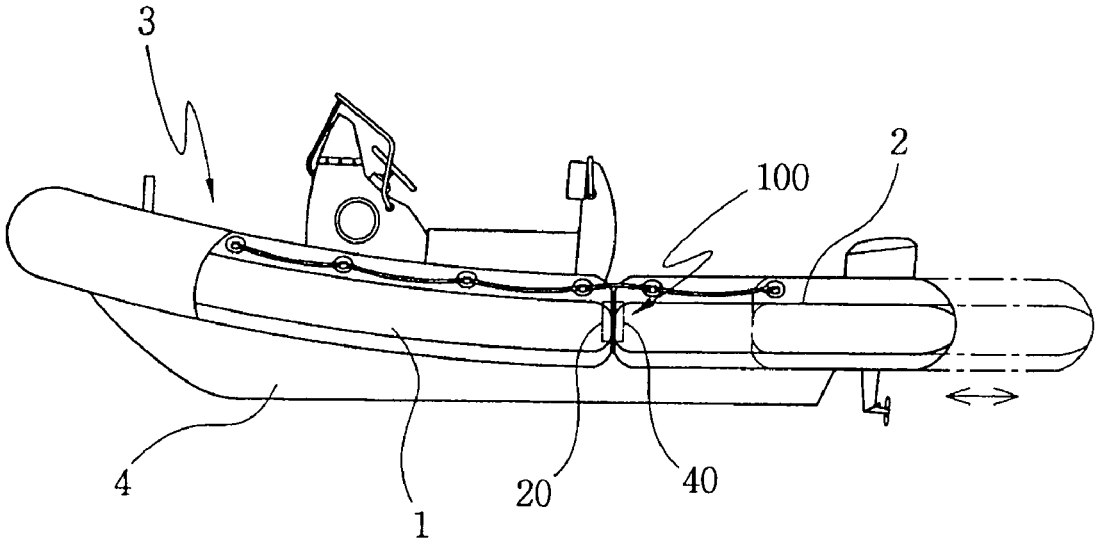
【Fig 10】
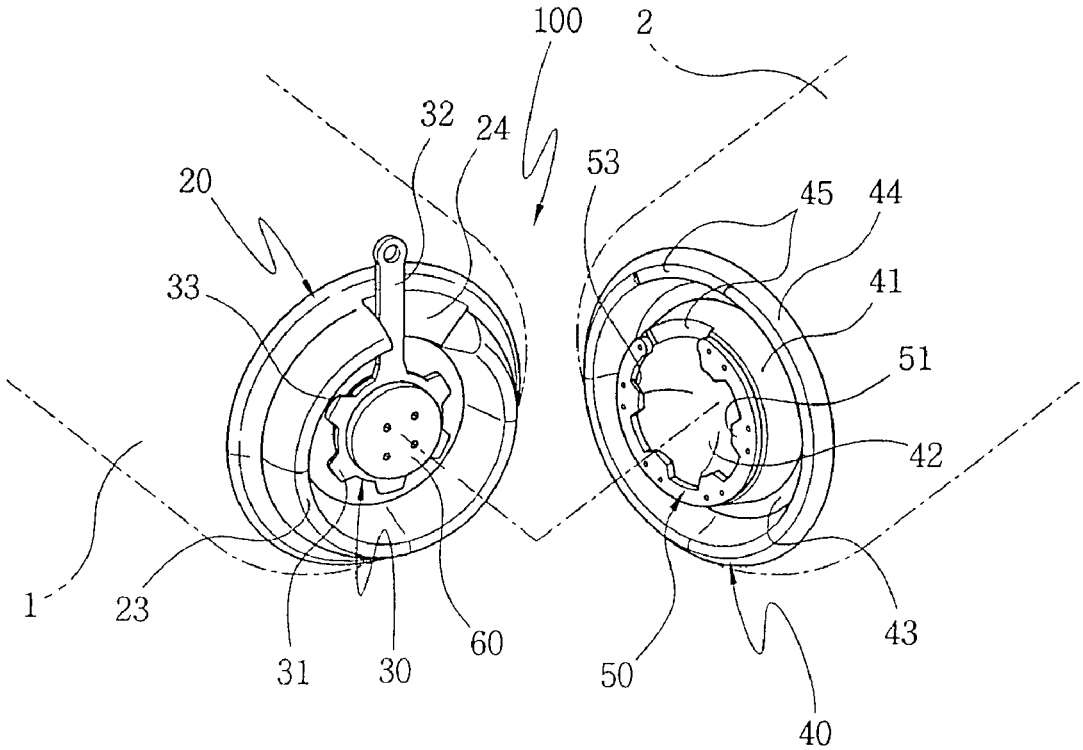

【Fig 11】
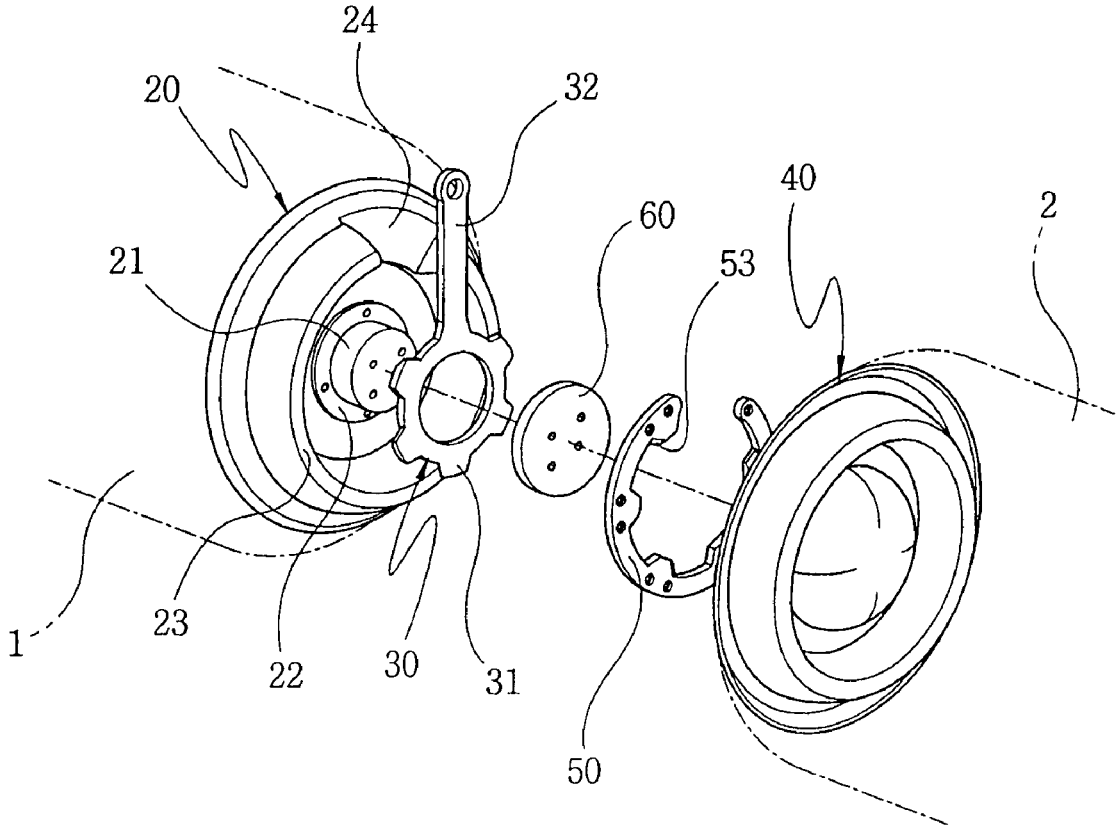
【Fig 12A】
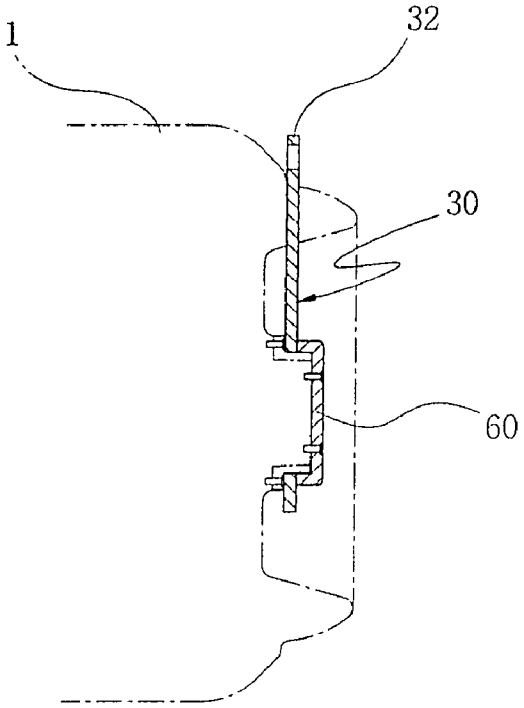

【Fig 12B】
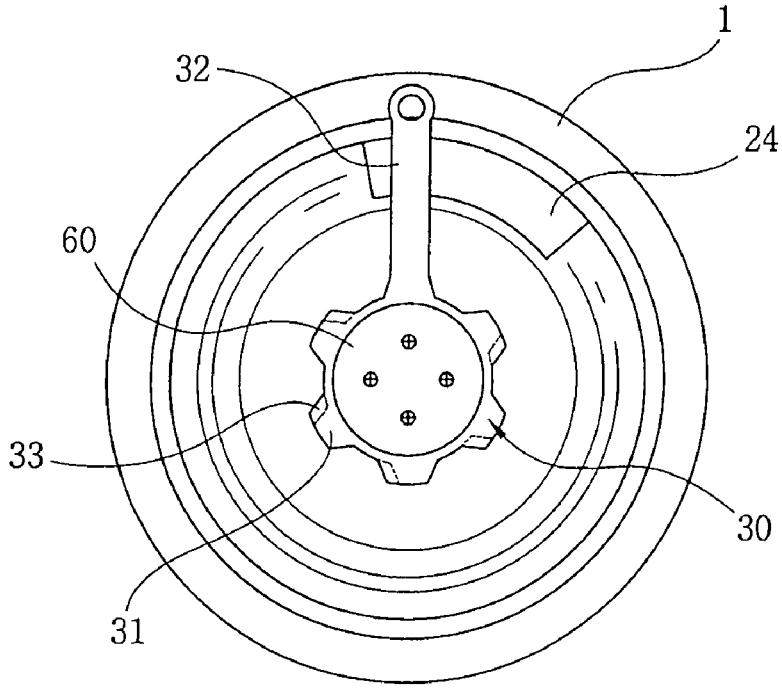
【Fig 13】
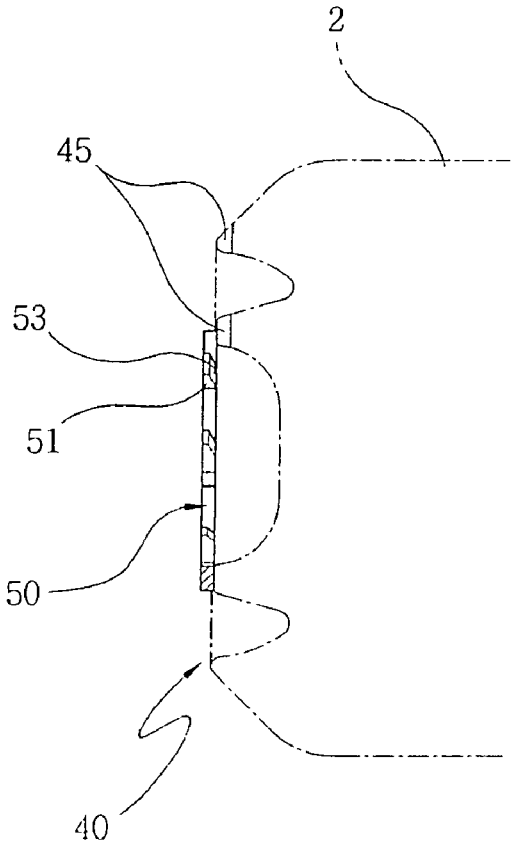

【Fig 14A】
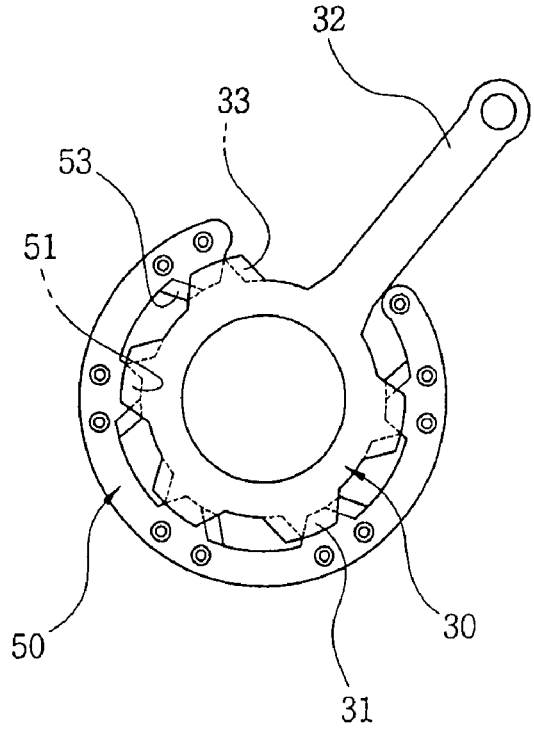
【Fig 14B】
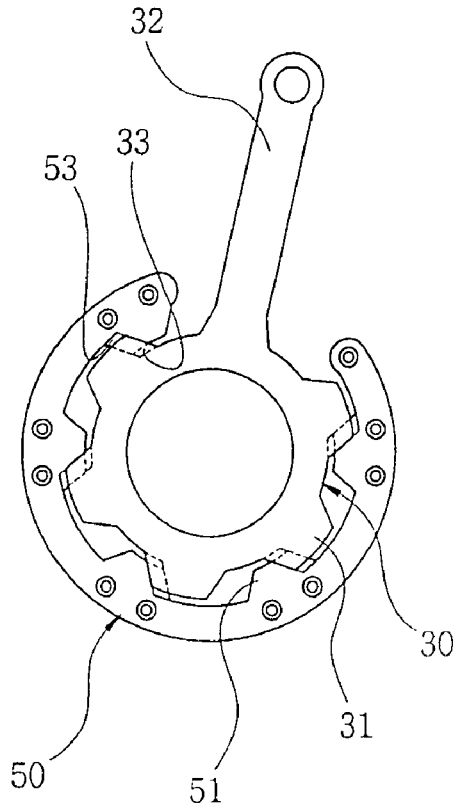

【Fig 14C】
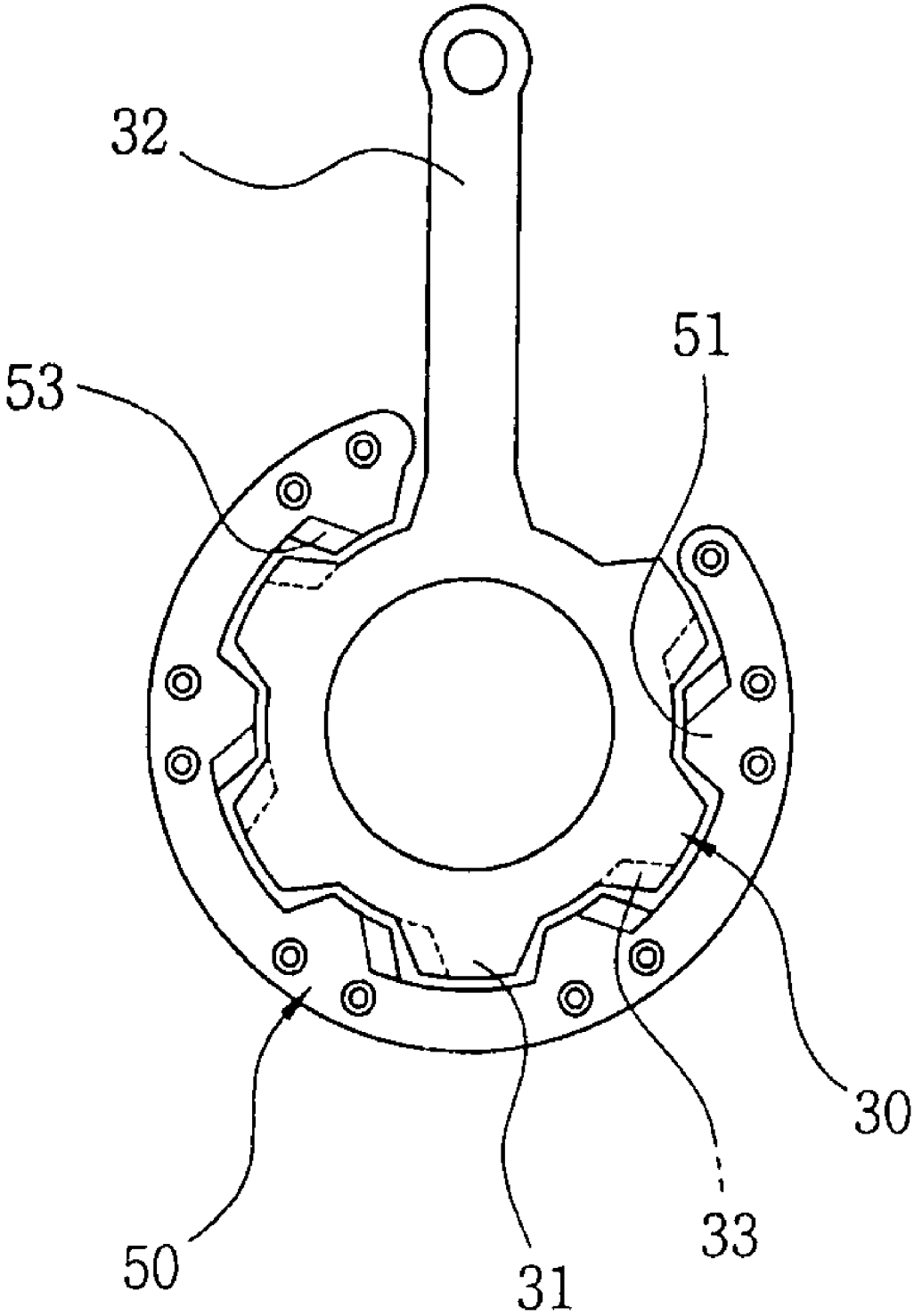

RIGID INFLATABLE BOAT WITH EASY LIFESAVING

BACKGROUND OF THE INVENTION

1. Field of the Invention

The present invention relates generally to a rigid inflatable boat with easy lifesaving, and more particularly to a rigid inflatable boat with easy lifesaving, which gives a considerable reduction in necessary time for saving a person from drowning in the case of the emergency, by separating a tube to be installed to the rigid inflatable boat into an arc-shaped front tube and a rear tube, by fixedly installing the arc-shaped front tube at a front side of a hull and slideably installing the rear tube at a rear side of the arc-shaped front tube, and by allowing the rear tube to quickly move in the backward direction, thereby an open space is created between a rear end of the arc-shaped front tube and a front end of the rear tube, and consequently it is possible to quickly lift up the drowning person through the open space.

2. Description of the Related Art

A conventional rigid inflatable boat for saving a person from drowning in the case of the emergency is shown in FIGS. 1 and 2. Arc-shaped front tubes 1 are fixedly installed at both front sides of a hull. Rear tubes 2 are fixedly installed at both rear sides of the hull. A middle tube 15 is detachably inserted between a rear end of the arc-shaped front tube 1 and a front end of the rear tube 2. An open space for allowing a person to come in or go out is provided between the rear end of the arc-shaped front tubes 1 and the front end of the rear tube 2 with opposite to the middle tube 15.

The middle tube 15 is provided with a protrusion 16 at a front side and a rear side thereof, which comprises a semi-solid material. The semi-solid material of the protrusion 16 is stronger than the materials of the outer surfaces of the expanded front tube 1 and the expanded rear tube 2. An air injection port 17 is formed at a middle portion of the middle tube 15. The middle tube 15 expands by injecting the air therein through the injection port 17 and thereafter it is inserted into the space between the rear end of the arc-shaped front tubes 1 and the front end of the rear tube 2. If the middle tube 15 further expands by injecting the air therein through the injection port 17, it fully fills the space between the rear end of the arc-shaped front tubes 1 and the front end of the rear tube 2.

If a user wants to save a person from drowning by using this conventional rigid inflatable boat 3, he or she must make the middle tube 15 to be constricted by deflating the air from the middle tube 15. If the middle 15 becomes shrank, it is possible to rapidly move the rear tube 2 in the backward direction between the rear end of the arc-shaped front tubes 1 and the front end of the rear tube 2. As a result, it is possible to lift up the drowning person through the open space due to the contraction of the middle tube 15.

After saving the drowning person, the middle tube 15 expands again by injecting the air therein through the injection port 17. Then, the expanded middle tube 15 can block the space between the rear end of the arc-shaped front tubes 1 and the front end of the rear tube 2.

However, one drawback of this conventional rigid inflatable boat is that the work for mounting and detaching the middle tube 15 is troublesome. Another drawback of the conventional rigid inflatable boat is that a long time occurs to perform the process for mounting or detaching the middle tube 15, and thereby resulting in the retardation of saving the drowning person. Another drawback of the conventional rigid inflatable boat is that any air injection device is essential to expand the middle tube 15 again.

SUMMARY OF THE INVENTION

The present invention solves the foregoing problems. It is an object of the present invention to provide a rigid inflatable boat with easy lifesaving, which gives a considerable reduction in necessary time for saving a person from drowning in the case of the emergency, by separating a tube to be installed to the rigid inflatable boat into an arc-shaped front tube and a rear tube, by fixedly installing the arc-shaped front tube at a front side of a hull and slideably installing the rear tube at a rear side of the arc-shaped front tube, and by allowing the rear tube to quickly move in the backward direction, thereby an open space is created between a rear end of the arc-shaped front tube and a front end of the rear tube, and consequently it is possible to quickly lift up the drowning person through the open space.

It is other object of the present invention to provide a rigid inflatable boat with easy lifesaving, which can firmly support an arc-shaped front tube and a rear tube so that they are not separated from each other when a shock generated in the course of movement of a boat upon water is transmitted to a hull of the rigid inflatable boat, which can gives a considerable reduction in necessary time for saving a person from drowning in the case of the emergency, by installing a holding device for detachably combining the arc-shaped front tube with the rear tube, in which the holding device may easily mounted at or detached from the position between the rear end of the arc-shaped front tube and the front end of the rear tube.

It is another object of the present invention to provide a rigid inflatable boat with easy lifesaving, which can ensure the strong and tight engagement between an arc-shaped front tube and a rear tube and can prevent them from being transformed during the separation or the engagement, which can gives a considerable reduction in necessary time for connecting the arc-shaped front tube and the rear tube, and which can previously prevent any accident from being generated in the course of movement of a boat upon water, by employing the female-male fitting structure between the arc-shaped front tube and the rear tube.

In order to achieve these objects, the present invention provides a rigid inflatable boat with easy lifesaving including an arc-shaped front tube fixedly installed at an upper portion of a hull and a rear tube slideably installed at the upper portion of a hull, characterized by comprising:

at least one sliding rail being formed an upper surface of the hull at a one side or both sides thereof and extends in the longitudinal direction of the hull;

a guiding member being disposed in the sliding rail, in which the rear tube can slide along the sliding rail in the forward and the backward directions due to the operation of the guiding member; and a first holding means for detachably supporting a rear end of the arc-shaped tube and a front end of the rear tube being installed between the rear end of the arc-shaped tube and the front end of the rear tube.

In addition, according to the present invention, the first holding means comprises a holding device, the holding device including:

a first fixing member being attached and fixed to an end of the arc-shaped tube or the rear tube, the first fixing member having a shaft which protrudes from the center of the first fixing member, and a ring being installed at a root portion of the shaft;

a moving ring being pivotally fitted onto the shaft and being supported by a cap that is arranged to be in threaded engagement with the shaft, the moving ring having a plurality of moving lugs protruding from an outer circumferential surface thereof and a lever extending from the outer circumferential surface thereof to the outside at a predetermined length;

a second fixing member being attached and fixed to the other end of the arc-shaped front tube or the rear tube such that it is opposite to the first fixing member, the second fixing member including a ring fixing protrusion which has a ring shape and protrudes from a one side of the second fixing member, in which the ring fixing protrusion defines a space for receiving the shaft and the moving ring; and a C-shaped fixing ring being arranged to be in threaded engagement with the ring fixing protrusion and having a plurality of fixing lugs, in which the fixing lugs radially protrudes from an inner circumferential surface and it correspond to the moving lug of the moving ring;

when the first fixing member is combined with the second fixing member, the moving lug of the moving ring is positioned into the fixing lug of the fixing ring, and the moving lug and the fixing lug are forcibly compressed with each other due to the pivotal movement of the lever.

In addition, according to the present invention, a ring-shaped portion is formed at the outside of the ring fixing protrusion of the second fixing member, wherein a ring-shaped protrusion protrudes from an outer side surface of the first fixing member and it has a cut-away portion for allowing the lever to pivotally move at its one side, when the first fixing member is combined with the second fixing member, the ring-shaped protrusion is forcibly combined with the ring-shaped portion, and thereby the first fixing member is tightly engaged with the second fixing member.

In addition, according to the present invention, the moving lug has a first slanted surface formed at a one side inner surface thereof and the fixing lug has a second slanted surface formed at a one side inner surface thereof, and thereby the moving lug is smoothly contacted with the fixing lug. A plurality of grooves for obtaining a sufficient operational space of the lever are formed at the ring fixing protrusion of the second fixing member and an outer circumferential portion, in which the grooves correspond to an opening of the first fixing member and an opening of the fixing ring.

BRIEF DESCRIPTION OF THE DRAWINGS

The above objects and other characteristics and advantages of the present invention will become more apparent by describing in detail preferred embodiments thereof with reference to the attached drawings, in which:

FIG. 1 is a plan view of a rigid inflatable boat according to a prior art;

FIG. 2 is a fragmentary sectional view of a main part in the rigid inflatable boat as shown in FIG. 1;

FIG. 3 is a schematic perspective view of a rigid inflatable boat with easy lifesaving according to the first embodiment of a present invention;

FIG. 4 is a side view of the rigid inflatable boat with easy lifesaving according to the first embodiment of a present invention;

FIG. 5 is a plan view of the rigid inflatable boat with easy lifesaving according to the first embodiment of the present invention;

FIG. 6 is a fragmentary enlarged view showing the operation of the constitutional parts taken along the single-dotted circle line "A" as illustrated in FIG. 4;

FIG. 7 is a sectional view taken along the line B-B as illustrated in FIG. 6;

FIG. 8 is a sectional view similar to FIG. 7, for showing the rigid inflatable boat with easy lifesaving according to a second embodiment of the present invention;

FIG. 9 is a side view of the rigid inflatable boat with easy lifesaving according to the present invention, for showing the state that a holding device is mounted thereto;

FIG. 10 is a perspective view of the holding device being employed in the rigid inflatable boat with easy lifesaving according to the present invention;

FIG. 11 is an exploded perspective view of the holding device being employed in the rigid inflatable boat with easy lifesaving according to the present invention;

FIG. 12A is a sectional view of a first fixing member of the holding device, and FIG. 12B is a front view of the first fixing member of the holding device;

FIG. 13 is a sectional view of a second fixing member of the holding device; and FIGS. 14A to 14C show operational states of the holding device.

DETAILED DESCRIPTION OF THE INVENTION

Hereinafter, a rigid inflatable boat with easy lifesaving according to preferred embodiments of the present invention will be explained in more detail with reference to the accompanying drawings FIGS. 3 to 14.

As shown in FIGS. 3 to 7, the rigid inflatable boat with easy lifesaving 3 includes an arc-shaped tube 1 and a rear tube 2 installed to an upper portion of a hull 4. The arc-shaped tube 1 is fixedly installed at both sides of the upper portion of the hull 4. At least one sliding rail 6 is formed an upper surface of the hull 4 at a one side or both sides thereof and it extends in the longitudinal direction of the hull 4.

A guiding member 9 is disposed in the sliding rail 6 at a lower portion of the rear tube 2. The rear tube 2 can slide along the sliding rail 6 by means of the guiding member 9 in the forward and the backward directions. A first holding means for detachably supporting a rear end of the arc-shaped tube 1 and a front end of the rear tube 2 are installed between the rear end of the arc-shaped tube 1 and the front end of the rear tube 2.

A tube supporting frame 10 for supporting an inner surface of the rear tube 2 upwardly protrudes from the upper surface of the hull 4 at a predetermined distance from the rear end of the arc-shaped front tube 1. An opening 11 for saving a person from drowning is formed between a front end of the tube supporting frame 10 and the rear end of the arc-shaped front tube 1. A second holding means for holding the rear tube 2 at the tube supporting frame 10 is installed at the tube supporting frame 10 and the rear tube 2.

FIG. 8 shows a rigid inflatable boat with easy lifesaving according to a second embodiment of the present invention. At least one sliding rail 6*a* is formed an upper surface of the tube supporting frame 10 at a one side or both sides thereof and extends in the longitudinal direction of the tube supporting frame 10. A guiding member 9*a* is disposed in the sliding rail 6*a*, the rear tube 2 can slide along the sliding rail 6*a* by means of the guiding member 9*a* in the forward and the backward directions. The guiding members 9,9*a* are connected with each other by means of a hard connecting piece 13, thereby the guiding member 9, the inner guiding member 9*a* and the hard connecting piece 13 are integrally detachably installed to the surface of the rear tube 2.

As shown in FIGS. 7 to 8, a rail groove 7 is formed on the sliding rail 6 and the inner sliding rail 6*a* and it has a narrow entrance and a relatively broad inner portion. Due to this structure, the guiding member 9 and the inner guiding member 9*a* are slideably guided along the rail groove 7 of the sliding rail 6 and the inner sliding rail 6*a*. At this time, the guiding member 9 and the inner guiding member 9*a* do not leave their orbits in the sliding rail 6 and the inner sliding rail 6*a*.

As shown in FIGS. 6 to 8, the tube supporting frame 10 and the rear tube 2 have a ring 9*a*, respectively, and a rope 8 for preventing the rear tube 2 from leaving its orbit extends between the rings 9*a*. Preferably, the first holding means and the second holding means comprise a magic tape 12, respectively. Alternatively, the first holding means and the second holding means comprise a hook or a clamp.

As shown in FIG. 9, the first holding means comprises a holding device 100 for rapidly, exactly and safely performing the connection and the separation works between the arc-shaped front tube 1 and the rear tube 2. The separateably holding means 100 is installed between the rear end of the arc-shaped front tube 1 and the front end of the rear tube 2 and it may allow the arc-shaped front tube 1 and the rear tube 2 for being connected or separated due to the pivotal movement of a handle or a lever. As shown in FIGS. 10 to 13, the holding device 100 includes a first fixing member 20, a moving ring 30, a second fixing member 40 and a fixing ring 50. The first and the second fixing members 20,40 have an approximate disk shape, respectively such that they correspond with the shape of the tube to be used in the rigid inflatable boat 3. It will readily be understood that the shape of the first and the second fixing members 20,40 can be optionally changed.

The first fixing member 20 can be attached and fixed to the rear end of the arc-shaped tube 1 or the front end of the rear tube 2. Likewise, the second fixing member 20 can be attached and fixed to the rear end of the arc-shaped tube 1 or the front end of the rear tube 2. Preferably, the first fixing member 20 is attached and fixed to the rear end of the arc-shaped tube 1, and the second fixing member 20 is attached and fixed to the front end of the rear tube 2.

The first fixing member 20 and the second fixing member 20 comprise a metal or a synthetic resin. The first fixing member 20 and the second fixing member 20 are attached and fixed to the rear end of the arc-shaped tube 1 and the front end of the rear tube 2 by means of an adhesive agent. The first fixing member 20 has a disk-shaped body, and it includes a shaft 21 protruding from the center of the first fixing member 20 and a ring 22 installed at a root portion of the shaft 21.

If the moving ring 30 is engaged into the fixing ring 50, a predetermined space is created in the fixing ring 50 by means of the ring 22. Due to this structure, it is possible to protect the first fixing member from being damaged owing to the rotational friction of the moving ring 30. As needed, the ring 22 has a stage shape such that the height of the ring 22 corresponds to the thickness of the fixing ring 50 at the root portion of the shaft 21. The ring 22 is integrally formed with the shaft 21.

The moving ring 30 is a constitutive element that corresponds to the fixing ring 50. The moving ring 30 is pivotally fitted onto the shaft 21 so that it is combined to the shaft 21 with maintaining a proper tolerance there between. The moving ring 30 is supported by a cap 60 that is arranged to be in threaded engagement with the shaft 21. The plurality of moving lugs 31 protrude from an outer circumferential surface of the moving ring 30 and a lever 32 for rotating the moving ring 30 extends from the outer circumferential surface thereof.

Meanwhile, the second fixing member 40 is attached and fixed to the front end of the rear tube 2 such that it is opposite to the first fixing member 20. The second fixing member 40 has a ring fixing protrusion 41, which has a ring shape and protrudes from a one side of the fixing member 40, in which the ring fixing protrusion 41 defines a space 42 for receiving the shaft 21 and the moving ring 30. If the first fixing member 20 is combined with the second fixing member 40, the shaft 21 (including the cap) of the first fixing member 20 and the moving ring 30 are received into the space 42.

The fixing ring 50 is arranged to be in threaded engagement with the ring fixing protrusion 41 and has a plurality of fixing lugs 51, which radially protrudes from an inner circumferential surface and corresponds to the moving lug 31 of the moving ring 30. The fixing ring 50 has a C-shaped ring in which a radial cut-away portion is formed at a one side of the fixing ring 50 in order to allow the lever 32 to pivotally move there through.

If the first fixing member 20 is combined with the second fixing member 40, the moving lug 31 of the moving ring 30 is positioned into the fixing lug 51 of the fixing ring 50. The lever 32 can approach through a cut-away portion of the fixing ring 50. The moving lug 31 and the fixing lug 51 are forcibly compressed with each other due to the pivotal movement of the lever 32. Consequently, the first fixing member 20 is tightly combined with the second fixing member 40.

In the meantime, a ring-shaped portion 43 is formed at the outside of the ring fixing protrusion 41 of the second fixing member 40. A ring-shaped protrusion 23 is formed at an outer side surface of the first fixing member 20.

When the first fixing member 20 is combined with the second fixing member 40, the ring-shaped protrusion 23 is inserted into the ring-shaped portion 43. Accordingly, the first fixing member 20 may be tightly combined with the second fixing member 40 with safe. At this case, since the moving ring 30 to be installed at the first fixing member 20 is inserted into the shaft 21, it is necessary to obtain an operational space for the lever 32 extending from a radial one end of the moving ring 30. To this end, a one side of the ring-shaped protrusion 23 is machined to be open and thereby a cut-away portion 24 is provided.

As described above, when the first fixing member 20 is combined with the second fixing member 40, the moving ring 30 is positioned into the fixing ring 50. At this time, it is necessary to obtain an operational space for the lever 32 in the second fixing member 40. To this end, a one side of the fixing ring 50 is machined to be open such that it corresponds to the opening 24. The plurality of fixing lugs 51 radially protruding from the inner circumferential surface of the fixing ring 50 lean to the outside of the fixing ring 50. Since the thickness of the remaining portion of the fixing ring 50 is larger than that of the moving ring 30, it is possible to obtain the operational space for the moving ring 20 and the lever 32.

To obtain a sufficient operational space for the lever 32, a plurality of grooves 45 are formed at the ring fixing protrusion 41 of the second fixing member 40 and an outer circumferential portion 44 of the ring fixing protrusion 41. The positions and the angles of the grooves 45 correspond to those of the openings of the first fixing member 20 and the fixing ring 50.

Due to this combining structure, it is possible to prevent the arc-shaped front tube 1 and the rear tube 2 from being estranged during the separation or the engagement. Sine the moving ring 30 is strongly fixed with the fixing ring 50 after combining, the rear tube 2 does not easily separated from the arc-shaped front tube 1. That is, when a shock generated in the course of movement of a rigid inflatable boat upon water, the rear tube 2 does not easily separated from the arc-shaped front tube 1. Accordingly, it is possible to prevent a secondary accident from being occurred in the course of movement of the rigid inflatable boat with easy lifesaving.

Meanwhile, the moving lug 31 has a first slanted surface 33 formed at a one side inner surface thereof and the fixing lug 51 has a second slanted surface 53 formed at a one side inner surface thereof, and thereby the moving lug 31 smoothly contacts with the fixing lug 51. However, it will readily be understood that the rotational operation of the lever for ensuring the tight engagement between the moving ring 30 and the fixing ring 50 should preferably be due to the tolerance there between.

In the case of emergency at the sea, it is preferable to obtain an operational reliability and a safety of the rigid inflatable boat with easy lifesaving due to the rapid and safe separation and engagement between the arc-shaped front tube 1 and the rear tube 2.

If the moving lug 31 and the fixing lug 51 have the slanted surface 33,53 formed at their inner surfaces, the moving ring 30 can be rapidly engaged with the fixing ring 50 at safety. That is, the moving ring 30 rotates due to the pivotal movement of the lever 32. At this time, the slanted surface 33 of the moving ring 30 and the slanted surface 53 of the fixing ring 50 overlap each other in a state that the distal end of the moving lug 31 is not contacted with the distal end of the fixing lug 51.

Now the manner in which the rigid inflatable boat with easy lifesaving according to the present invention is operated will be described.

The rear end of the arc-shaped front tube 1 and the front end of the rear tube 2 are tightly engaged with each other by means of the first holding means. Likewise, the inner surfaces of the tube supporting frame 10 and the rear tube 2 are tightly engaged with each other by means of the second holding means, that is the magic tape 12. As shown in FIG. 14A, if the arc-shaped front tube 1 and the rear tube 2 are tightly engaged with each other by means of the holding device 100, the first fixing member 20 is integrally combined with the second fixing member 40 due to the engagement between the moving ring 30 and the fixing ring 50.

In order to save a person from drowning in the course of movement of the rigid inflatable boat with easy lifesaving according to the present invention, the magic tape 12 for tightly engaging the rear end of the arc-shaped front tube 1 with the front end of the rear tube 2 is detached there from at first. Likewise, the magic tape 12 for tightly engaging the inner surfaces of the tube supporting frame 10 and the rear tube 2 is also detached there from. As a result, the rear tube 2 can slide in the backward direction.

Under the installation of the holding device 100, if a user grapes the lever 32 with hand and rotates it in the loosing direction, the moving ring 30 rotates with centering around the shaft 21 of the first fixing member 20 due to the pivotal movement of the lever 32, as shown in FIGS. 14A and 14B. If the lever 32 is pivotally rotated at the state shown in FIG. 14C, the moving lug 31 and the fixing lug 51 do not overlap each other, and they set to an open state. Consequently, the rear tube 2 may be released from the arc-shaped front tube 1 and it can slide in the backward direction.

In order to slideably move the rear tube 2 backwards, the magic tape 12, which is the first and the second holding means, is detached and the lever 32 of the holding device 100 is pivotally rotated in the opening direction. As shown in FIGS. 7 and 8, the guiding member 9 installed at the downstream of the rear tube 2 is guided along the sliding rail 6 formed on the upper surface of the hull 4. The inner guiding member 9*a* installed at the inner surface of the rear tube 2 is guided along the sliding rail 6*a* installed on the tube supporting frame 10 and thereby the rear tube 2 can slide in the backward direction.

As shown in FIGS. 5 and 6, since the rope 8 extends between the rings 8*a* of the tube supporting frame 10 and the rear tube 2, it is possible to prevent the rear tube 2 from leaving toward the outside of the hull 4.

If the rear tube 2 is pushed backwards, an open space for allowing a person to access is provided between the rear end of the arc-shaped front tube 1 and the front end of the rear tube 2 as shown in FIGS. 3 to 6. Since the opening 11 is formed at the hull 4 of which the open space for allowing a person to access is provided, an opening created by the rear tube 2 is open together with the opening 11. At this time, in the opening 11, the tube supporting frame 10 for supporting the arc-shaped front tube 1 and the rear tube 2 is removed.

Since the opening created between the rear end of the arc-shaped front tube 1 and the front end of the rear tube is open together with the opening 11, a lifesaving board 14 carrying a drowning man may be quickly and easily lifted up onto the upper surface of the deck 5 of the rigid inflatable boat 3 through the space and the opening 11 as shown in FIG. 5. After lifting up the drowning man onto the deck 5, an artificial respiration may be tried upon him.

If the rigid inflatable boat 3 moves toward a certain big ship or goes ashore, the rear tube 2 slides in the forward direction in order to move it towards the rear end of the arc-shaped front tube 1. After closing the open space of the tube, the arc-shaped front tube 1 and the rear tube 2 are firmly engaged with each other by attaching the magic tape 12 again or by rotating the lever 32 of the holding device 100 in the locking direction.

In more detail, the rear tube 2 slides in the forward direction so that it is closely combined with the rear end of the arc-shaped front tube 1. Then, the shaft 21 and the moving ring 30 are received into the space 42 of the ring fixing protrusion 41. The ring-shaped protrusion 23 is fitted into the ring-shaped portion 43. As a result, the arc-shaped front tube 1 is combined with the rear tube 2 again by means of the holding device 100.

If a user rotates the lever 32 in the locking direction, the moving ring 30 can rotate from the opening state illustrated in FIG. 14C to the locking state illustrated in FIG. 14A. Then, the moving lug 31 of the moving ring 30 and the fixing lug 51 of the fixing ring 50 overlap and are firmly engaged each other. Since the slanted surfaces 33,35 are formed at the inner surfaces of the moving lug 31 and the fixing lug 51, the operation of the lever 32 is further smoothly performed.

Since the guiding members 9,9*a* are connected with each other by means of the hard connecting piece 13, the rear tube 2 that expands by a pneumatic pressure does not directly contacted with the outer surface of the tube supporting frame 10. At this time, a gap is created between the rear tube 2 and the tube supporting frame 10. Due to this structure, the rear tube 2 can smoothly slide without subjecting a contact resistance while the rear tube 2 slideably moves in the forward and the backward directions.

The rear tube 2 according to the present invention may be one side or both sides of the hull 4. While the present invention has been particularly shown and described with reference to a particular embodiment thereof, it will be understood by those skilled in the art that various changes in form and details may be effected therein without departing from the spirit and scope of the invention as defined by the appended claims. For example, the structure of the fixing members 20,40, the moving ring 30 and the fixing ring 50 of the holding device 100 can be changed in accordance with the types of the tube. That is, the cap 60 for fixing the moving ring 30 can be fitted onto the outer peripheral surface of the shaft.

As described above, the rigid inflatable boat with easy lifesaving according to the present invention gives a considerable reduction in necessary time for saving a person from drowning in the case of the emergency, by separating a tube to be installed to the rigid inflatable boat into an arc-shaped front tube and a rear tube, by fixedly installing the arc-shaped front tube at a front side of a hull and slideably installing the rear tube at a rear side of the arc-shaped front tube, and by allowing the rear tube to quickly move in the backward direction, thereby an open space is created between a rear end of the arc-shaped front tube and a front end of the rear tube, and consequently it is possible to quickly lift up the drowning person through the open space.

What is claimed is:

1. A rigid inflatable boat adapted for ease of lifesaving, comprising an arc-shaped front tube fixedly installed at an upper portion of a hull and a rear tube slideably installed at the upper portion of a hull, at least one sliding rail being formed on an upper surface of the hull at one side or both sides thereof and extending in a longitudinal direction of the hull;

a guiding member disposed in the sliding rail, in which the rear tube is slidable along the sliding rail in forward and backward directions due to the operation of the guiding member; and a first holding means for detachably supporting a rear end of the arc-shaped tube and a front end of the rear tube, the first holding means being provided between the rear end of the arc-shaped tube and the front end of the rear tube.

2. The rigid inflatable boat as claimed in claim 1, wherein the first holding means comprises a holding device, the holding device comprising:

a first fixing member attached and fixed to an end of the arc-shaped tube or the rear tube, the first fixing member having a shaft which protrudes from the center of the first fixing member, and a ring provided at a root portion of the shaft;

a moving ring pivotally fitted onto the shaft and being supported by a cap that is arranged to be in threaded engagement with the shaft, the moving ring having a plurality of moving lugs protruding from an outer circumferential surface thereof and a lever extending from the outer circumferential surface thereof to the outside at a predetermined length;

a second fixing member attached and fixed to the other end of the arc-shaped front tube or the rear tube such that it is opposite to the first fixing member, the second fixing member including a ring fixing protrusion which has a ring shape and protrudes from a one side of the second fixing member, the ring fixing protrusion defining a space for receiving the shaft and the moving ring; and a C-shaped fixing ring arranged to be in threaded engagement with the ring fixing protrusion and having a plurality of fixing lugs, the fixing lugs radially protruding from an inner circumferential surface and corresponding to the moving lugs of the moving ring;

whereby when the first fixing member is combined with the second fixing member, the moving lugs of the moving ring are positioned between the fixing lugs of the fixing ring and the moving lugs and the fixing lugs are brought into engagement with each other by pivotal movement of the lever.

3. The rigid inflatable boat as claimed in claim 1, wherein a tube supporting frame for supporting an inner surface of the rear tube upwardly protrudes from the upper surface of the hull, and wherein an opening for saving a person from drowning is formed between a front end of the tube supporting frame and the rear end of the arc-shaped front tube.

4. The rigid inflatable boat as claimed in claim 2, wherein a tube supporting frame for supporting an inner surface of the rear tube upwardly protrudes from the upper surface of the hull, and wherein an opening for saving a person from drowning is formed between a front end of the tube supporting frame and the rear end of the arc-shaped front tube.

5. The rigid inflatable boat as claimed in claim 2, wherein a ring-shaped portion is formed at the outside of the ring fixing protrusion of the second fixing member, wherein a ring-shaped protrusion protrudes from an outer side surface of the first fixing member and has a cut-away portion for allowing the lever to pivotally move at its one side, and when the first fixing member is combined with the second fixing member, the ring-shaped protrusion is forcibly combined with the ring-shaped portion, and thereby the first fixing member is tightly engaged with the second fixing member.

6. The rigid inflatable boat as claimed in claim 2, wherein the moving lug has a first slanted surface formed at a one side inner surface thereof and the fixing lug has a second slanted surface formed at a one side inner surface thereof, and thereby the moving lug is smoothly contacted with the fixing lug.

7. The rigid inflatable boat as claimed in claim 2, wherein a plurality of grooves for obtaining a sufficient operational space of the lever are formed at the ring fixing protrusion of the second fixing member and an outer circumferential portion and the grooves correspond to an opening of the first fixing member and an opening of the fixing ring.

8. The rigid inflatable boat as claimed in claim 3, wherein a second holding means for detachably holding the rear tube at the tube supporting frame is provided at the tube supporting frame and the rear tube.

9. The rigid inflatable boat as claimed in claim 3 or 4, wherein an inner sliding rail is longitudinally provided at the tube supporting frame, and an inner guiding member is provided at an inner side surface of the rear tube so that it is guided along the inner sliding rail.

10. The rigid inflatable boat as claimed in claim 9, wherein a rail groove is formed on the sliding rail and the inner sliding rail and the rail groove has a narrow entrance and a relatively broad inner portion, whereby the guiding member and the inner guiding member are inserted in and slideably guided along the rail groove of the sliding rail and the inner sliding rail, respectively.

11. The rigid inflatable boat as claimed in claim 9, wherein the guiding member is connected with the inner guiding member by means of a hard connecting piece, whereby the guiding member, the inner guiding member and the hard connecting piece are integrally detachably attached to the surface of the rear tube.

12. The rigid inflatable boat as claimed in claim 3 or 4, wherein the tube supporting frame and the rear tube each have a ring, and a rope extends between the rings.

* * * * *